US007667197B2

(12) United States Patent
Lin et al.

(10) Patent No.: US 7,667,197 B2
(45) Date of Patent: Feb. 23, 2010

(54) MASS ANALYZING APPARATUS

(75) Inventors: Che-Hsin Lin, Kaohsiung (TW); Jen-Taie Shiea, Kaohsiung (TW); Wei-Jen Hsu, Kaohsiung (TW); Liang-Tsuen Chen, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 265 days.

(21) Appl. No.: 11/778,666

(22) Filed: Jul. 17, 2007

(65) Prior Publication Data

US 2008/0277579 A1 Nov. 13, 2008

(30) Foreign Application Priority Data

May 8, 2007 (TW) ..... 96116297 A

(51) Int. Cl.
*B01D 59/46* (2006.01)

(52) U.S. Cl. ..... 250/288; 250/281; 250/282; 250/423 R; 315/111.21; 315/111.31; 313/231.31

(58) Field of Classification Search ..... 250/281, 250/282, 288, 423 R, 426; 315/111.21, 111.31; 313/231.31; 219/121.36
See application file for complete search history.

(56) References Cited

U.S. PATENT DOCUMENTS 3,757,518 A * 9/1973 Bahr ..... 60/202
4,963,735 A * 10/1990 Okamoto et al. ..... 250/288
6,169,370 B1 * 1/2001 Platzer ..... 315/111.21
6,949,741 B2 * 9/2005 Cody et al. ..... 250/288
7,112,785 B2 * 9/2006 Laramee et al. ..... 250/288
7,157,721 B1 * 1/2007 Blanchard ..... 250/423 R
7,576,322 B2 * 8/2009 Karpetsky et al. ..... 250/288
2004/0149221 A1 * 8/2004 Koshimizu et al. ..... 118/723 R
2005/0056776 A1 * 3/2005 Willoughby et al. ..... 250/281
2005/0121607 A1 * 6/2005 Miller et al. ..... 250/287
2006/0273254 A1 * 12/2006 Berkout et al. ..... 250/288
2007/0007448 A1 * 1/2007 Wang ..... 250/288

OTHER PUBLICATIONS

Wei-Jen Hsu et al., "The application of atmospheric pressure low temperature plasma with new mass spectrometry methods," Abstracts Book of 2006 Nano Symposium in Da-Yen University, pp. 24, Dec. 8, 2006.

(Continued)

*Primary Examiner*—David A Vanore
*Assistant Examiner*—Michael J Logie
(74) *Attorney, Agent, or Firm*—Volentine & Whitt, PLLC

(57) ABSTRACT

The present invention relates to a mass analyzing apparatus, comprising a first metal electrode plate, a second metal electrode plate, an RF power supply, a reactant gas and a mass spectrometry. The second metal electrode plate is grounded. There is a gap between the first metal electrode plate and the second metal electrode plate. The RF power supply is electrically connected to the first metal electrode plate. Electric discharge is caused between the first metal electrode plate and the second metal electrode plate, so that the reactant gas becomes dissociation plasma. The dissociation plasma reacts with a gas analyte from a sample and then enters the mass spectrometry for a mass analysis. In addition, since the dissociation plasma is generated under low temperature and atmospheric pressure, the mass analyzing apparatus of the present invention is applicable for biological samples that need to be analyzed at a low temperature.

10 Claims, 10 Drawing Sheets

OTHER PUBLICATIONS

Wei-Jen Hsu et al., "The Development of a Low-Temperature Atmospheric Pressure Plasma for Mass Spectrometry Analysis," Proceedings of 2006 Nano Symposium in Da-Yen University, pp. 71-74, Dec. 8, 2006.

Wei-Jen Hsu et al., "A Novel Low Temperature Atmospheric Pressure Plasma Generator for High Throughput Chinese Herbs Analysis with Mass Spectrometry," Abstracts Book of ChinaNANO 2007 International Conference on Nanoscience and Technology, China, pp. 106-107 and 115, Jun. 4-6, 2007.

* cited by examiner

MASS ANALYZING APPARATUS

BACKGROUND OF THE INVENTION

1. Field of the Invention

The present invention relates to a mass analyzing apparatus. More particularly, the present invention relates to a mass analyzing apparatus capable of generating an ionization source by an RF power, without sample pretreatment at normal temperature and atmospheric pressure.

2. Description of the Related Art

In the conventional art, chemical compositions in samples (such as Chinese medicinal herbs) are analyzed by detection through liquid chromatography/mass spectrometer (LC/MS) or gas chromatography/mass spectrometer (GC/MS). The samples must be pretreated by being extracted with a solvent before being analyzed, so as to get signals.

FIG. 1 is a schematic view of an ionization source for a conventional direct analysis in real time (DART) as disclosed in U.S. Pat. No. 7,112,785.

Taking positive ions for example, the operational principle of the ionization source 1 includes: atoms of an inert gas (e.g., helium gas) that flow around the ionization source 1 are excited or ionized by a high voltage field at one atmosphere of pressure, as shown in Equation (1); next, the generated helium ions ($He^+$) or the excited-state helium atoms ($He^*$) impact with water molecules ($H_2O$) in the atmosphere, to generate water ions ($H_2O^+$) and electrons ($e^-$), as shown in Equation (2); then, water ions ($H_2O^+$) react with other water molecules ($H_2O$), to generate hydrated ions ($H_3O^+$), as shown in Equation (3); finally, the hydrated ions and molecules (M) of a gas analyte from a sample perform an ion-molecule reaction, so as to generate molecular ions ($MH^+$) of the analyte, as shown in Equation (4). Besides the above ionization process, the molecular ions of the analyte can also be formed by directly impacting the helium ions or excited state helium molecules with gas analyte, as shown in Equation (5).

$$He \longrightarrow He^+ \cdot \text{ or } He^* \quad (1)$$

$$He^+, He^* + H_2O \longrightarrow H_2O^+ \cdot + He + e^- \quad (2)$$

$$H_2O^+ \cdot + H_2O \longrightarrow H_3O^+ + OH \quad (3)$$

$$H_3O^+ + M \longrightarrow MH^+ + H_2O \quad (4)$$

$$He^+, He^*, H_2O^+ \cdot + M \longrightarrow MH^+ + He, H_2O \quad (5)$$

The ionization source 1 has a metal needle 11 therein, and a DC high voltage is applied to the metal needle 11. Extremely high electric field intensity is generated due to the very small area of the top end of the metal needle 11, and the helium stream flows in through an inlet 12 behind the metal needle 11, to perform the reactions of Equations (1) to (3). As the ion-molecule reaction is merely suitable for gas molecules, the helium stream flows through a heating region 13, so that the temperature of the helium gas flowing out from the outlet 14 of the ionization source 1 is between 50° C. and 70° C. Once the hot gas stream containing helium gas, helium ions, and excited state helium molecules impacts the surface of the sample (usually, a solid), the chemicals on the surface of the sample are likely to be volatilized, so as to be reacted with the hydrated ions in the atmosphere to form analyte ions, i.e., perform the reactions of Equations (4) and (5). Then, the analyte ions enter a mass spectrometer for a mass analysis.

The ionization source 1 is characterized by its operation at an atmospheric pressure, so mass signals of the sample can be obtained without any sample treatment, which is very helpful for the object to be analyzed within a very short time or in situ in real time. The ionization source 1 can be used for analysis in the following situations: the detection of bombs in an airport and the rapid identification of air or water pollutants in environmental analysis. Additionally, the technique can also be used in situ to examine whether medicine is drugs, or to determine whether currency is real or fake by analyzing the ink chemicals.

The ionization source 1 is disadvantageous in that the operation environment is a high-voltage and high-temperature environment, which is very undesirable when the sample is a biomolecule, since the biomolecule is easily damaged in such an environment. Moreover, as the position where the plasma gas molecules are generated by the ionization source 1 is far away from the sample and the inlet of the mass spectrometer, after being dissociated, the excited state gas molecules are reduced to a basic state during the flight. Thus, the charge-carrying capacity of the sample molecules is reduced, which leads to poor detection efficiency. Additionally, the ionization source 1 needs a large gas stream, and therefore the operation cost is high.

Additionally, there is an inductively coupled plasma mass spectrometer (ICP MS), which is applied on ionizing metal atoms. However, in the ICP MS, in order to ionize the metal atoms, it is necessary to consume a large amount of energy, which is generally an AC voltage (1700 V) with an output power of 1200 W and an RF of 13.56 MHz. The temperature of the plasma generated at this condition is approximately between 6000° C. and 8000° C., and the used inert gas is argon gas (Ar), which cannot generate plasma discharge in an environment of high atmospheric pressure in order to generate ionized gas molecules, and thus cannot be applied in detecting biomolecules under an atmospheric pressure.

Therefore, it is necessary to provide a mass analyzing apparatus to solve the above problems.

SUMMARY OF THE INVENTION

The object of the present invention is to provide a mass analyzing apparatus, which includes: a first metal electrode plate, a second metal electrode plate, an RF power supply, a reactant gas, and a mass spectrometer. The first metal electrode plate has a plurality of first through-holes. The second metal electrode plate has a plurality of second through-holes, and the second metal electrode plate is grounded. There is a gap between the second metal electrode plate and the first metal electrode plate. The RF power supply is electrically connected to the first metal electrode plate, so that electric discharge is caused between the first metal electrode plate and the second metal electrode plate. The reactant gas passes through the first metal electrode plate and the second metal electrode plate, and the reactant gas becomes dissociation plasma. The plasma is blown out from the second through-holes of the second metal electrode plate, reacts with the gas analyte from the sample, and enters the mass spectrometer for a mass analysis. Therefore, the plasma is generated in an environment of atmospheric pressure and room temperature, in which the temperature is kept at about 50° C., and the maximum temperature of the gas does not exceed 70° C., and thus, the mass analyzing apparatus of the present invention is suitable for biological samples that should be operated at low temperature. Furthermore, the present invention can be used to perform a mass detection on solid, liquid, or gas samples, and it is not necessary to perform complicated pretreatments on the samples. Moreover, the plasma is immediately blown out from the second through-holes once it is generated and reacts with the gas analyte from the sample, so that the ionization efficiency is much higher than that of the conventional ionization source 1 does not exceed 70° C., and thus, the mass analyzing apparatus of the present invention is suitable for biological samples that should be operated at low temperature. Furthermore, the present invention can be used to perform a mass detection on solid, liquid, or gas samples, and it is not necessary to perform complicated pretreatments on the samples. Moreover, the plasma is immediately blown out from the second through-holes once it is generated and reacts with the gas analyte from the sample, so that the ionization efficiency is much higher than that of the conventional ionization source 1.

DETAILED DESCRIPTION OF THE INVENTION

Figure 1:
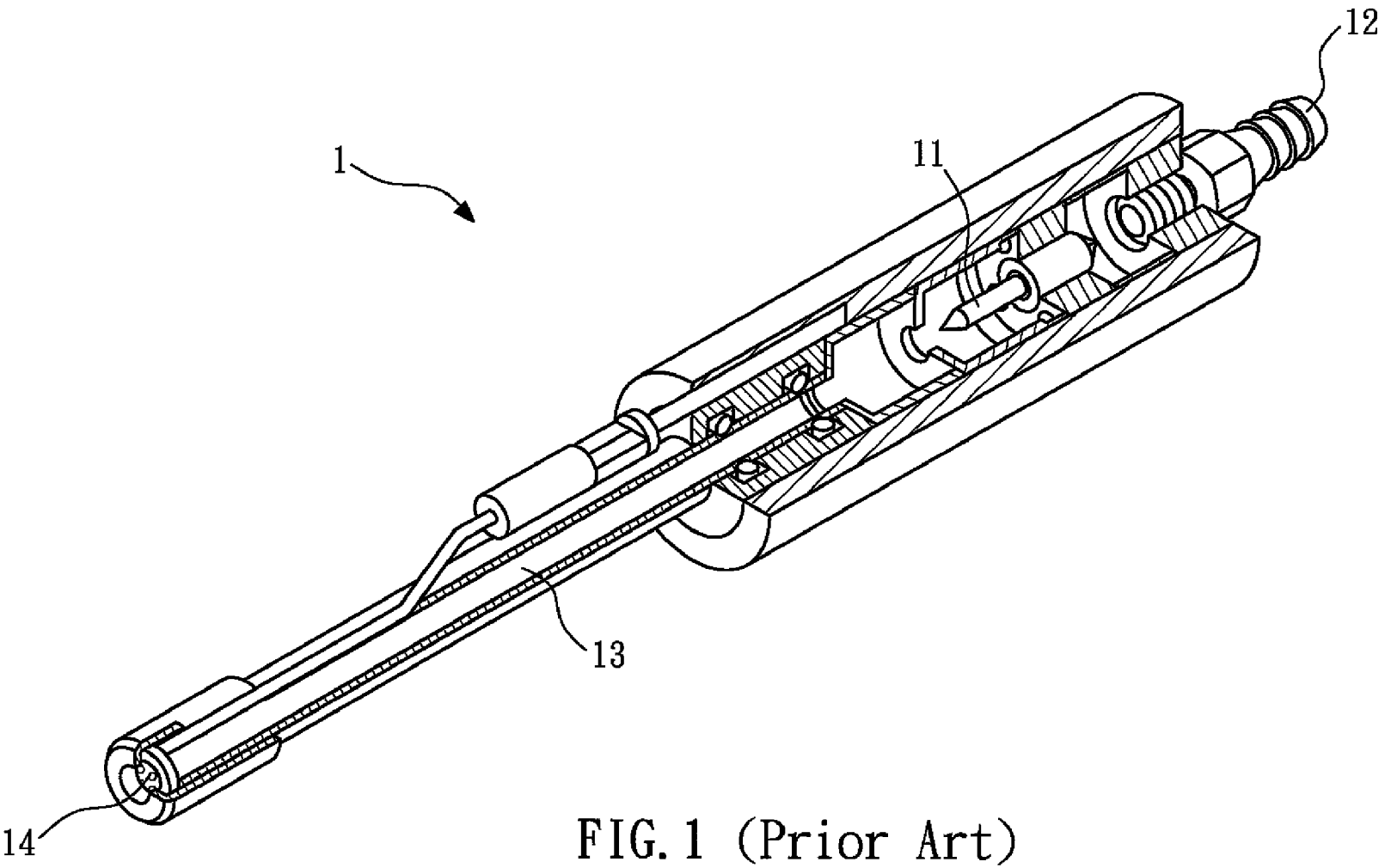
FIG. 1 (Prior Art)
FIG. 1 is a schematic view of an ionization source for a conventional direct analysis in real time (DART) as disclosed in U.S. Pat. No. 7,112,785.
Figure 2:
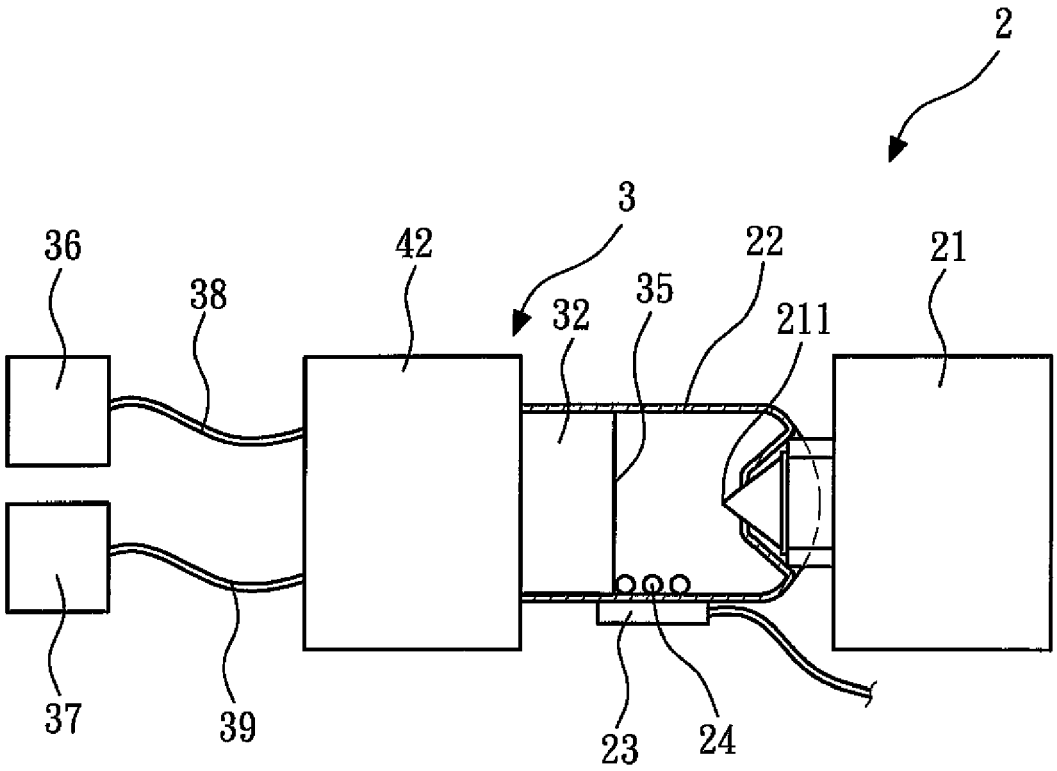
FIG. 2 is a schematic view of a mass analyzing apparatus of the present invention.
Figure 3:
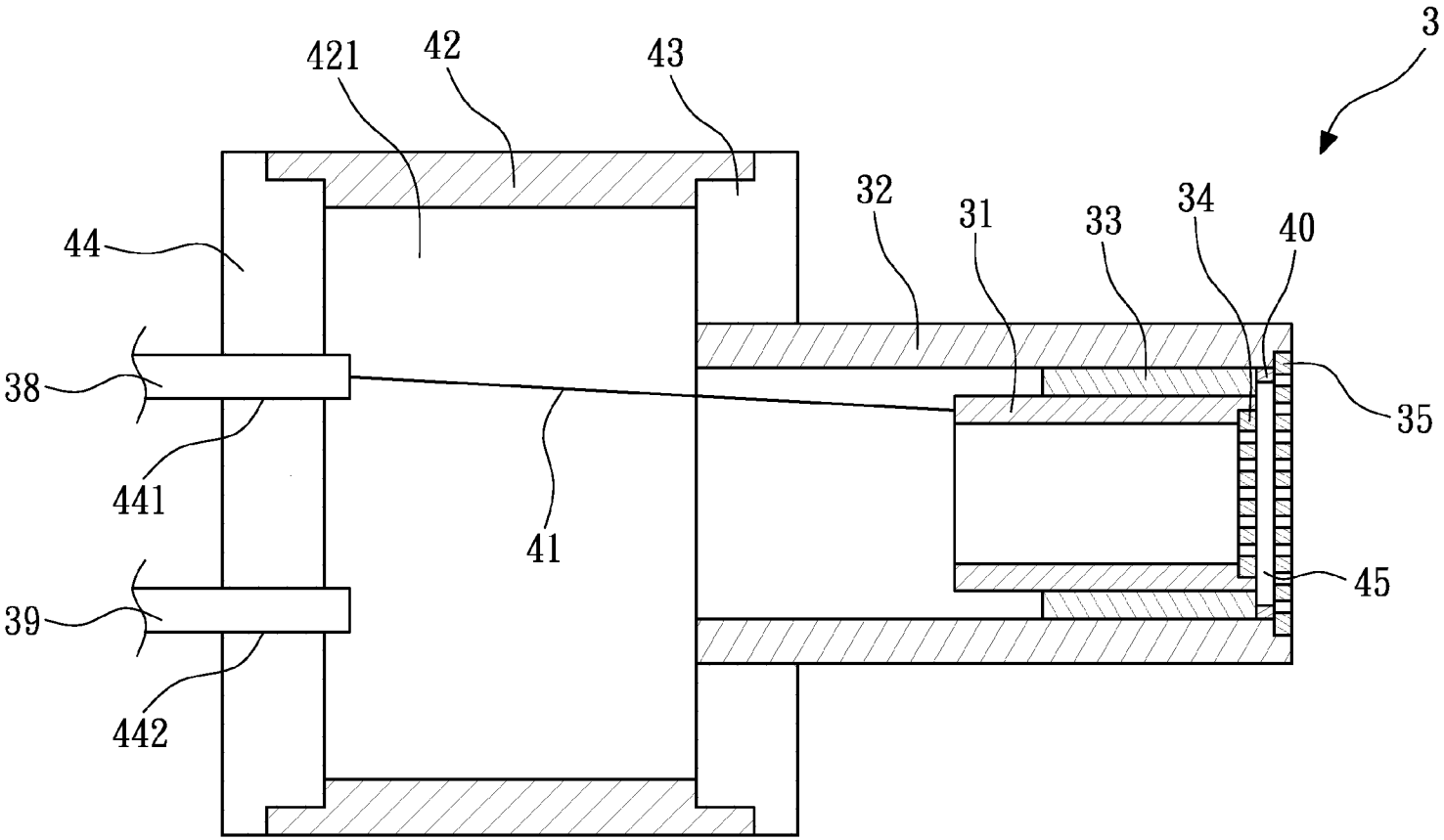
FIG. 3 is a sectional view of an ionization source for the mass analyzing apparatus of the present invention.

FIG. 2 shows a schematic view of a mass analyzing apparatus of the present invention. FIG. 3 shows a sectional view of an ionization source for the mass analyzing apparatus of the present invention. The mass analyzing apparatus 2 includes an ionization source 3, a mass spectrometer 21, a cover 22, a heating plate 23, and a sample 24. The ionization source 3 includes a first cylinder 31, a second cylinder 32, an insulation layer 33, a first metal electrode plate 34, a second metal electrode plate 35, an RF power supply 36, and a reactant gas supply 37.

The first cylinder 31 is located within the second cylinder 32, that is, the inner diameter of the first cylinder 31 is smaller than that of the second cylinder 32. The insulation layer 33 is located between the outer wall of the first cylinder 31 and the inner wall of the second cylinder 32. In this embodiment, the first cylinder 31 and the second cylinder 32 are made of stainless steel. The material of the insulation layer 33 is a high insulation material, such as Teflon, so as to electrically block the first cylinder 31 and the second cylinder 32.

The first metal electrode plate 34 has a plurality of first through-holes arranged in an array. The first metal electrode plate 34 is connected to an open end of the first cylinder 31. The second metal electrode plate 35 has a plurality of second through-holes arranged in an array. The second metal electrode plate 35 is connected to an open end of the second cylinder 32, and the second metal electrode plate 35 and the first metal electrode plate 34 are parallel and spaced apart from each other by a gap, so as to form a face discharge room 45. The first through-holes communicate with the face discharge room 45, and the second through-holes communicate with the face discharge room 45. In this embodiment, the second metal electrode plate 35 and the first metal electrode plate 34 have a ring-shaped pad 40 therebetween, so as to make the second metal electrode plate 35 and the first metal electrode plate 34 parallel and maintain a gap therebetween. The second metal electrode plate 35, the first metal electrode plate 34 and the ring-shaped pad 40 define the face discharge room 45. In this embodiment, the first metal electrode plate 34 and the second metal electrode plate 35 are made of conductive metal, such as stainless steel, aluminum, or copper, and they are disc shaped, and the diameter of the first metal electrode plate 34 is less than that of the second metal electrode plate 35. In this embodiment, the gap between the second metal electrode plate 35 and the first metal electrode plate 34 is about 0.5 mm.

In this embodiment, the ionization source 3 further includes a third cylinder 42, a front cover 43, and a back cover 44. The inner diameter of the third cylinder 42 is greater than that of the second cylinder 32. The third cylinder 42, the front cover 43, and the back cover 44 form a back cavity 421. The second cylinder 32 is connected to the front cover 43, and the cavity formed by the second cylinder 32 communicates with the back cavity 421. The back cover 44 has a first opening 441 and a second opening 442. In this embodiment, as the inner diameter of the third cylinder 42 is greater than that of the second cylinder 32, the ionization source 3 has a step-like appearance. However, it should be understood that the ionization source 3 can also not have the third cylinder 42 and the front cover 43, that is to say, the second cylinder 32 can be directly connected to the back cover 44 so the ionization source 3 has a single cylinder-shaped appearance.

The RF power supply 36 is connected to a first opening 441 of the back cover 44 through a first connecting pipe 38, and electrically connected to the first cylinder 31 through a wire 41, so as to supply an RF AC current to the first metal electrode plate 34. The second metal electrode plate 35 and the second cylinder 32 are directly grounded. As the distance between the second metal electrode plate 35 and the first metal electrode plate 34 is very small, an electric discharge is generated between the first metal electrode plate 34 and the second metal electrode plate 35. In this embodiment, the RF AC current supplied by the RF power supply 36 has a power of 15 W, and an RF of 13.56 MHz.

The reactant gas supply 37 is connected to a second opening 442 of the back cover 44 through a second connecting pipe 39 to input a reactant gas to the back cavity 421, and further input it to the first cylinder 31. The reactant gas can be, for example, helium gas, argon gas, nitrogen gas, or air. In this embodiment, the reactant gas is helium gas at a flow rate of 1-3 L/min. When the helium gas is introduced into the face discharge room 45 between the second metal electrode plate 35 and the first metal electrode plate 34, dissociation plasma is formed by the impact of the helium molecules on the high-energy electrons generated by the face discharging process occurred in the face discharge room 45, and the reaction is as shown in Equation (1). The dissociation plasma is then extruded and blown out by the net gas pressure generated by the continuously introduced helium gas, thereby departing from the second metal electrode plate 35.

The cover 22 is used to carry the sample 24 therein, and the sample 24 is located between the second metal electrode plate 35 of the ionization source 3 and the mass spectrometer 21. The cover 22 preferably further includes a heating plate 23 thereunder, for heating the sample 24, with the cover 22 located therebetween. If the sample 24 is volatile, a gas analyte is generated without being heated; if the sample 24 is nonvolatile, a gas analyte is generated upon being heated or being irradiated by a laser. Therefore, the present invention preferably further includes a laser generator (not shown) for generating a laser, so as to irradiate the sample 24 and thus generate a gas analyte.

Additionally, if desired, an opening (not shown) can be made below the cover 22, so that the heating plate 23 can directly carry and heat the sample 24.

The mass spectrometer 21 has a sample receiver 211. In this embodiment, the mass spectrometer 21 is manufactured by Micromass Company, with a model of Quattro LC system. The sample receiver 211 is located at the top end of a cone with a diameter of about 14 mm. One end (the left end in the figure) of the cover 22 covers the second cylinder 32 and the second metal electrode plate 35 of the dissociation source 3; and the other end (the right end in the figure) of the cover 22 forms a bowl-shaped shrinkage, and has a small hole at the top end for being sleeved on the sample receiver 211. In this way, the cover 22 forms a cavity with the upper part being substantially closed, so as to prevent the ions from being volatilized into the air. In this embodiment, the cover 22 is made of glass, and has a length of 57 mm.

When the plasma departs from the ionization source 3 and enters the cover 22, as the plasma contains a large amount of excited-state helium atoms (He*) and electrons therein, the plasma can perform a series of ion-molecule reactions and charge exchanges with the moisture in the air and the gas analyte (M) from the sample 24, so as to generate protonation molecular ions ($MH^+$) of the analyte, and the reactions are shown by Equations (1)-(5). The molecular ions of the analyte enter the mass spectrometer 21 through the sample receiver 211 for a mass analysis.

The present invention is advantageous in that the ionization source 3 can generate low-temperature plasma at atmospheric pressure, and after being consecutively operated for 60 min., the temperature of the second cylinder 32 of the ionization source 3 can still be stably maintained lower than 70° C. Therefore, the ionization source 3 of the present invention is extremely suitable for biological samples that should be analyzed at a low temperature. Additionally, the concentration of the ionized gas generated by the ionization source 3 of the present invention will be stably increased along with the input power and gas flow rate of the ionization source 3, which indicates that the ionization source 3 is extremely suitable for being applied as an ionization source for stable mass analysis. Furthermore, the present invention can directly perform mass detection on solid, liquid, or gas samples, and it is not necessary to perform a complicated pretreatment of the samples. Moreover, once generated, the plasma is immediately blown out through the second through-hole of the second metal electrode plate 35 and reacts with the gas analyte from the sample 24, and thus, the ionization efficiency is much higher than that of the conventional ionization source 1. Finally, as the ionization source 3 merely has gas input, the mass spectrometer 21 does not have the memory effect generated by the conventional ionization source, but performs consecutive analyses of various samples and does not affect the mass analysis signals of the next sample due to the memory effect. Additionally, a laser can be used to heat the samples having higher molecular weights, which is advantageous in focusing on a small area. Therefore, various positions on the sample surface can be detected selectively, and even consecutive detections can be performed, so as to obtain the molecular image of the sample.

The present invention is illustrated in detail through the following examples, but the present invention is not limited to the disclosure of the examples.

EXAMPLE 1

Figure 4:
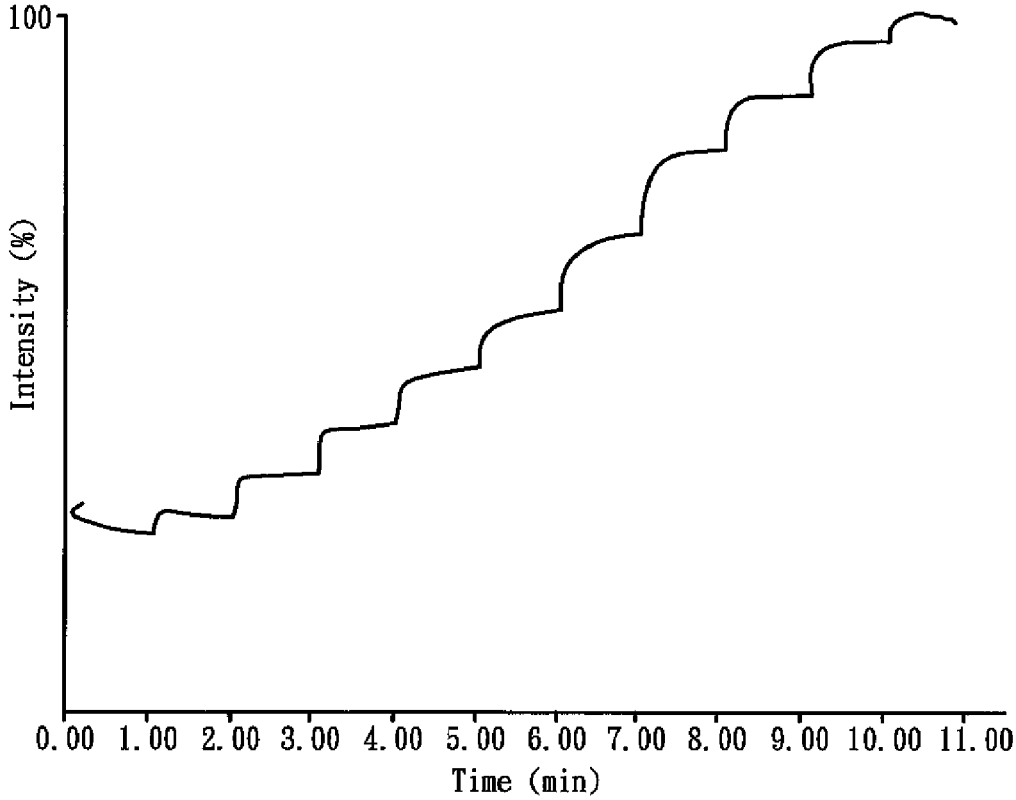
FIG. 4 shows an ion concentration curve of the ionization source of the present invention at different RF output powers.

FIG. 4 shows an ion concentration curve of the ionization source of the present invention at different RF output powers. This example aims at testing the concentration of the plasma ions generated by the ionization source 3 according to the above embodiment, and the experimental methods are listed as follows: the flow rate of the reactant gas is fixed at 6 L/min, and the output power of the RF power supply 36 is taken as the manipulating variable, the initial power of the RF power supply 36 is 6 W, and then is increased by 2 W in one stage. It can be seen in the experimental results shown in FIG. 4 that there is an obvious increment in each stage, which indicates that the ionization source 3 can indeed improve the ion concentration as the power increases stably, and the whole concentration magnitude falls in a range of $10^8$~$10^{10}$ ions per second, which meets the requirements for the concentration.

EXAMPLE 2

Figure 5:
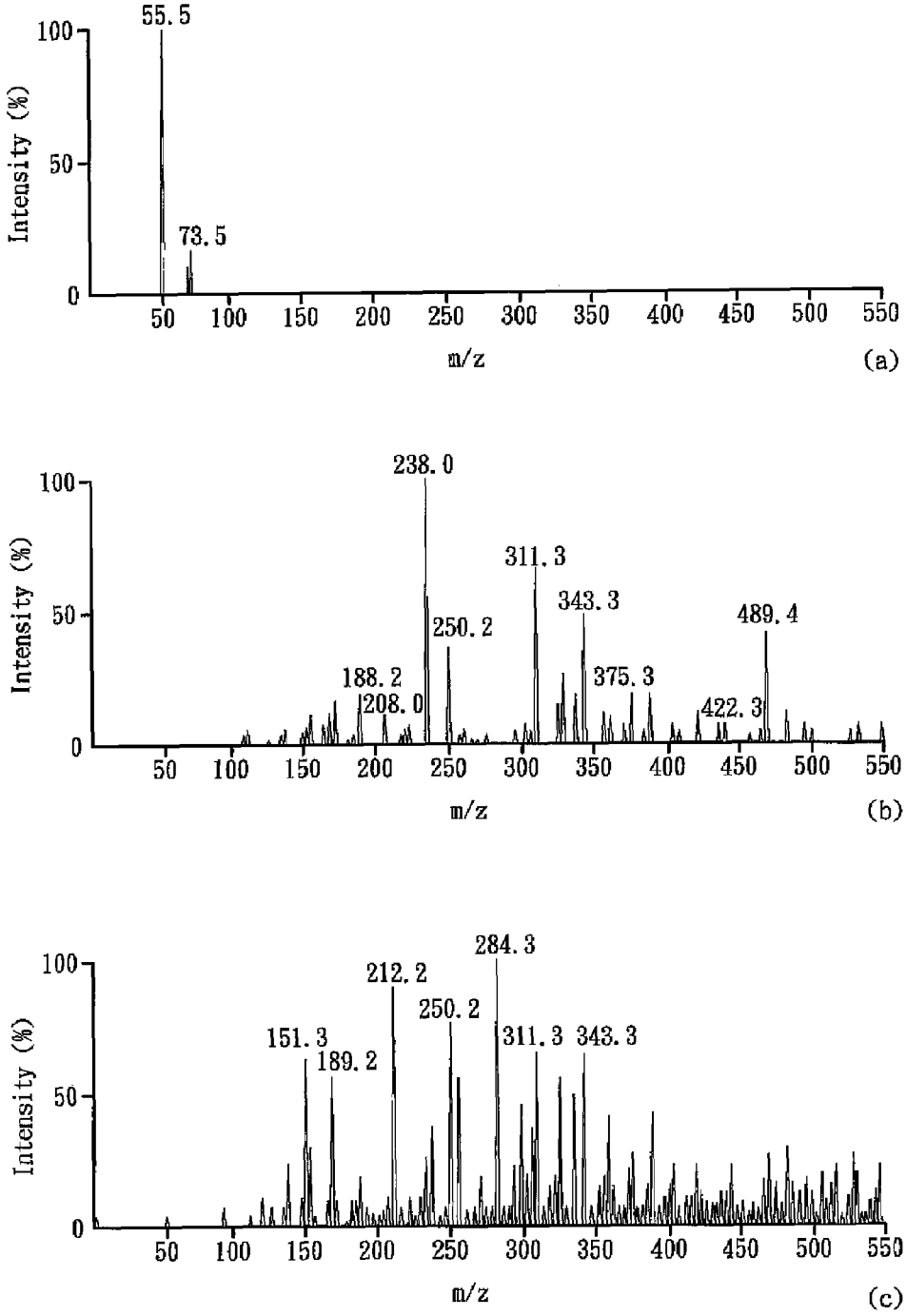
FIGS. 5*a* to 5*c* show mass spectrums measured by the mass analyzing apparatus of the present invention, in which the sample is chewing gum.

FIGS. 5*a* to 5*c* show mass spectrums measured by the mass analyzing apparatus of the present invention, in which the sample is chewing gum. In this example, the sample of chewing gum is sliced and then placed into the cover 22 of the mass analyzing apparatus 2 for testing. FIG. 5*a* shows a mass spectrum without the sample of chewing gum being placed therein, from which it can be seen that there is only one background peak signal.

FIG. 5*b* shows a mass spectrum with the sample of chewing gum being heated 70° C. by the heating plate 23, from which it can be seen that many molecular signals have been detected, and the labeled peaks are the spectrums of various saccharides in the chewing gum. FIG. 5*c* shows a mass spectrum with the sample of chewing gum being heated to 100° C. by the heating plate 23, from which it can be seen that more ingredients have been excited and detected.

EXAMPLE 3

Figure 6:
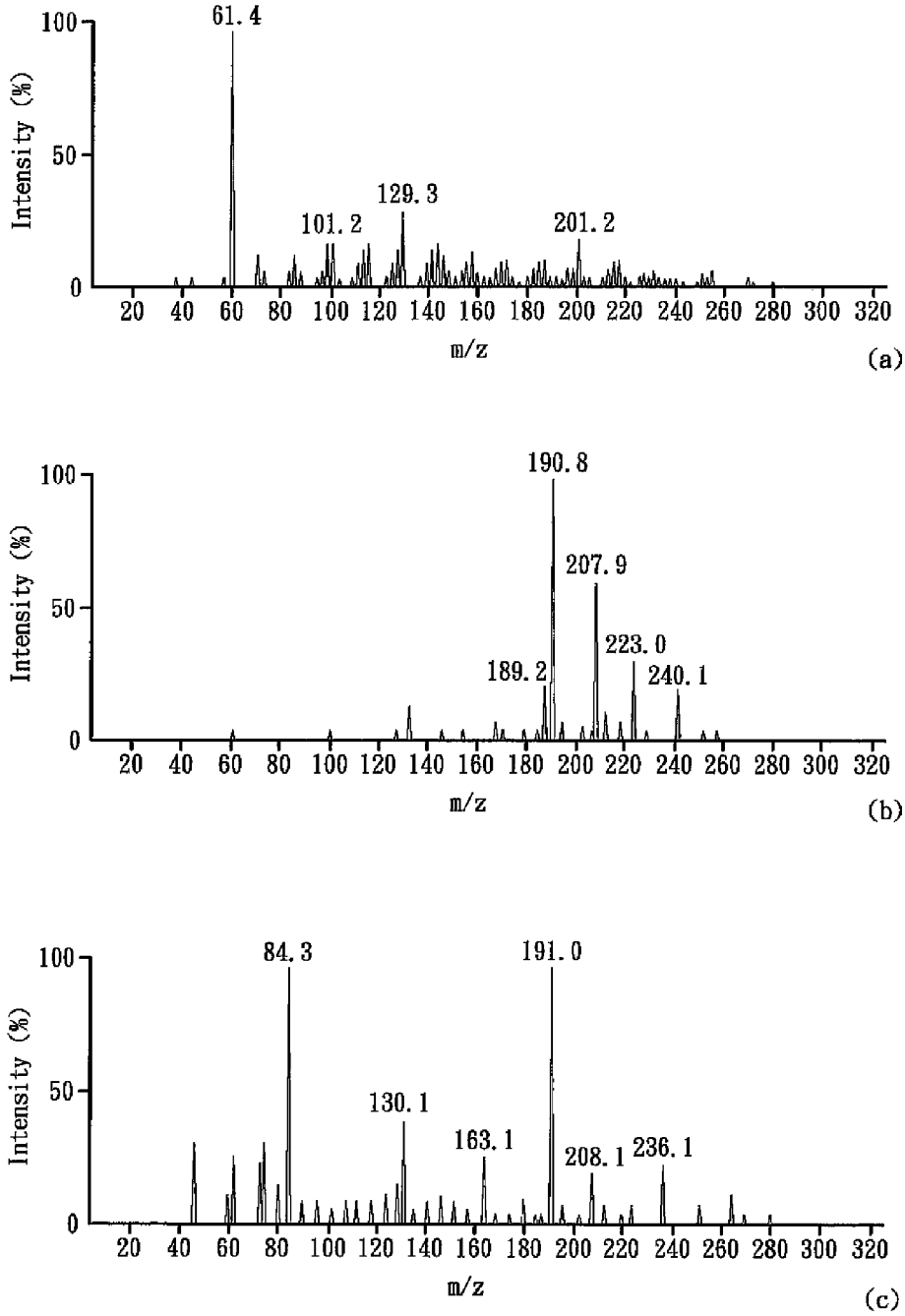
FIGS. 6*a* to 6*c* show mass spectrums measured by the mass analyzing apparatus of the present invention, in which the sample is angelica.

FIGS. 6*a* to 6*c* show mass spectrums measured by the mass analyzing apparatus of the present invention, in which the sample is angelica. In this example, the sample of angelica is sliced and then placed into the cover 22 of the mass analyzing apparatus 2 for testing. FIG. 6*a* shows a mass spectrum without the sample of angelica being placed therein, from which it can be seen that there is only one background peak signal. FIG. 6*b* shows a mass spectrum with the sample of angelica being heated to 70° C. by the heating plate 23, from which it can be seen that liqustilide (with a mass/charge ratio (m/z) of 190.8) and butylidene phthalide (with a mass/charge ratio (m/z) of 189.2) have been detected. FIG. 6*c* shows a mass spectrum with the sample of angelica being heated to 100° C. by the heating plate 23, from which it can be seen that umbelliferone (with a mass/charge ratio (m/z) of 163.1) has been excited and detected.

EXAMPLE 4

Figure 7:
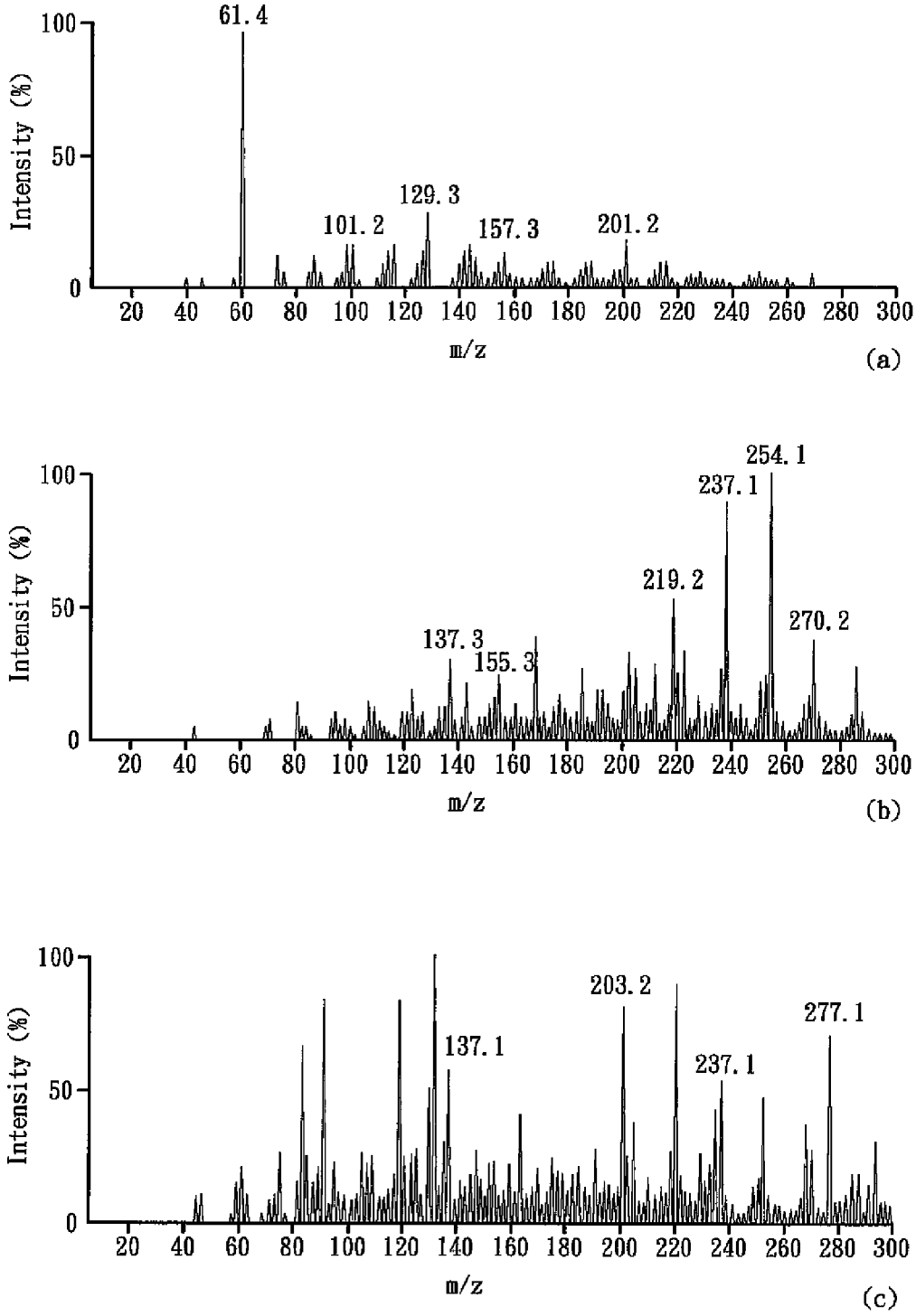
FIGS. 7*a* to 7*c* show mass spectrums measured by the mass analyzing apparatus of the present invention, in which the sample is dried ginger.

FIGS. 7*a* to 7*c* show mass spectrums measured by the mass analyzing apparatus of the present invention, in which the sample is dried ginger. In this example, the sample of dried ginger is sliced and then placed into the cover 22 of the mass analyzing apparatus 2 for testing. FIG. 7*a* shows a mass spectrum without the sample of dried ginger being placed therein, from which it can be seen that there is only one background peak signal.

FIG. 7*b* shows a mass spectrum with the sample of dried ginger being heated to 70° C. by the heating plate 23. FIG. 7*c* shows a mass spectrum with the sample of dried ginger being heated to 100° C. by the heating plate 23. As shown in FIGS. 7*b* and 7*c*, ion signals of main volatile substances in the dried ginger have been detected.

EXAMPLE 5

Figure 8:
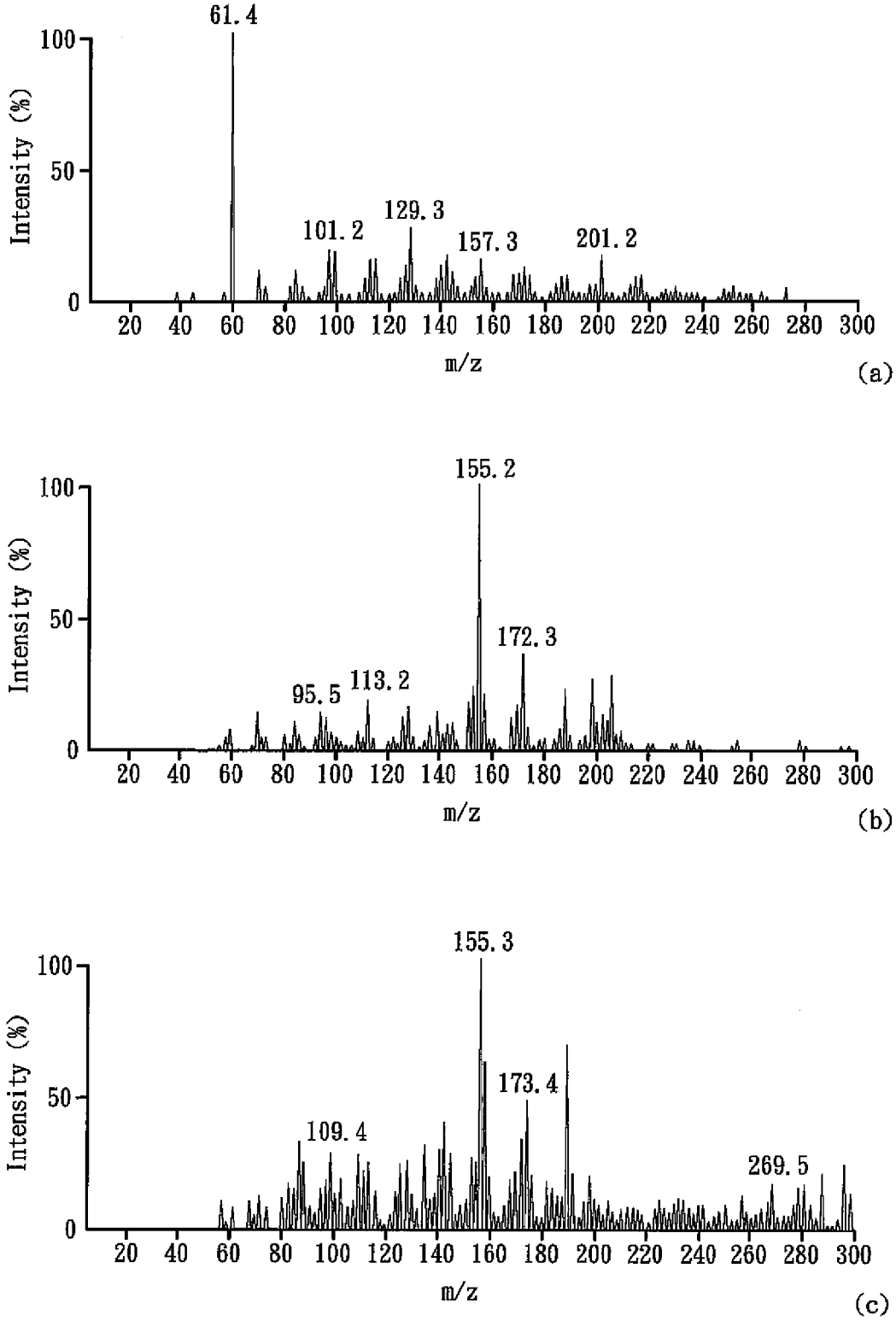
FIGS. 8*a* to 8*c* show mass spectrums measured by the mass analyzing apparatus of the present invention, in which the sample is peach seed.

FIGS. 8*a* to 8*c* show mass spectrums measured by the mass analyzing apparatus of the present invention, in which the sample is peach seed. In this example, the sample of peach seed is sliced and then placed into the cover 22 of the mass analyzing apparatus 2 for testing. FIG. 8*a* shows a mass spectrum without the sample of peach seed being placed therein, from which it can be seen that there is only one background peak signal. FIG. 8*b* shows a mass spectrum with the sample of peach seed being heated to 70° C. by the heating plate 23. FIG. 8*c* shows a mass spectrum with the sample of peach seed being heated to 100° C. by the heating plate 23. As shown in FIGS. 8*b* and 8*c*, ion signals of main volatile substances in the peach seed have been detected.

EXAMPLE 6

Figure 9:
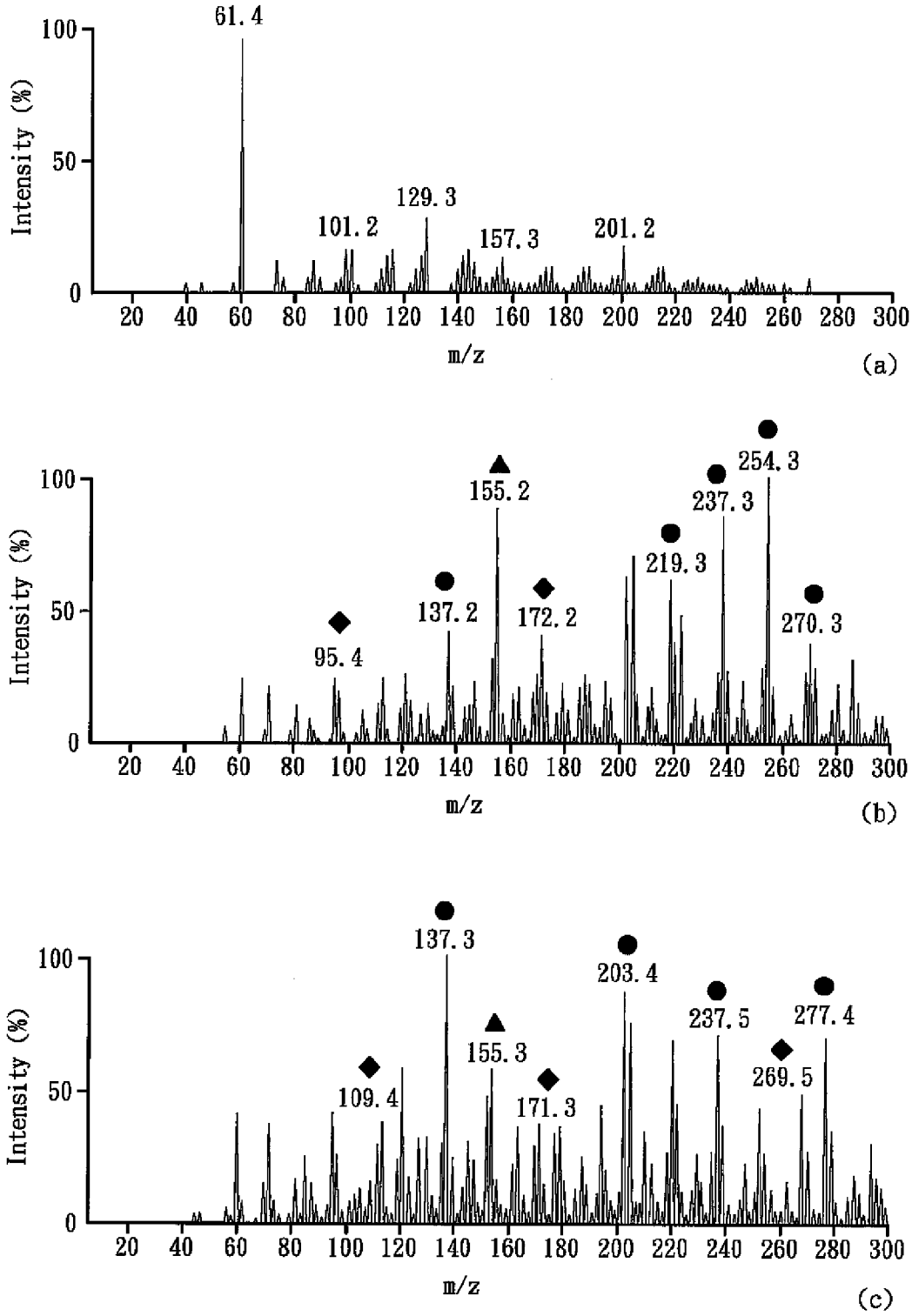
FIGS. 9*a* to 9*c* show mass spectrums measured by the mass analyzing apparatus of the present invention, in which the sample is dried ginger and peach seed.

FIGS. 9*a* to 9*c* show mass spectrums measured by the mass analyzing apparatus of the present invention, in which the samples are dried ginger and peach seed. In this example, the samples of dried ginger and peach seed are sliced and then placed into the cover 22 of the mass analyzing apparatus 2 for testing. FIG. 9*a* shows a mass spectrum without the samples of dried ginger and peach seed being placed therein, from which it can be seen that there is only one background peak signal. FIG. 9*b* shows a mass spectrum with the samples of dried ginger and peach seed being heated to 70° C. by the heating plate 23. FIG. 9*c* shows a mass spectrum with the samples of dried ginger and peach seed being heated to 100° C. by the heating plate 23. As shown in FIGS. 9*b* and 9*c*, individual signals from the two Chinese medicinal herbs have been detected, wherein ● indicates the signals of dried ginger, ♦ indicates the signals of peach seed, and ▲ indicates the co-signals of dried ginger and peach seed.

EXAMPLE 7

Figure 10:
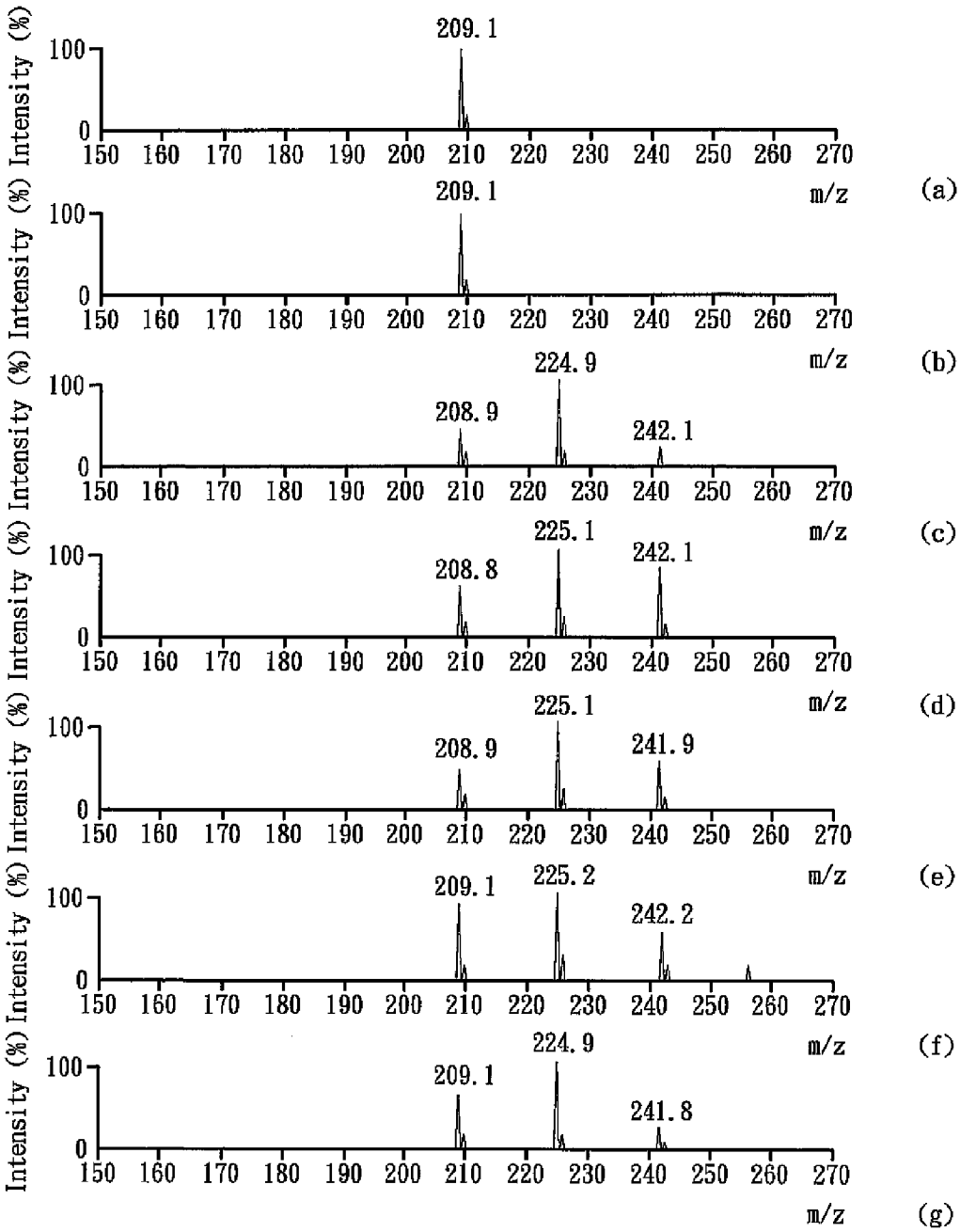
FIGS. 10*a* to 10*g* show mass spectrums measured at different times when monitoring the chalcone epoxidation reaction by the mass analyzing apparatus of the present invention.

FIGS. 10*a* to 10*g* show mass spectrums measured at different times when monitoring the epoxidation reaction of chalcone by the mass analyzing apparatus of the present invention, in which FIG. 10*a* shows the mass spectrum at 0.722 min., FIG. 10*b* shows the mass spectrum at 2.025 min., FIG. 10*c* shows the mass spectrum at 3.584 min., FIG. 10*d* shows the mass spectrum at 4.134 min., FIG. 10*e* shows the mass spectrum at 5.051 min., FIG. 10*f* shows the mass spectrum at 5.766 min., and FIG. 10*g* shows the mass spectrum at 6.372 min. In this example, $H_2O_2$ and NaOH are added into chalcone to perform the epoxidation reaction, and the reaction equation is shown as follows:

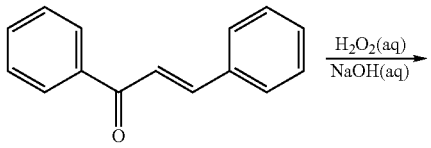

chalcone 1,3-Diphenyl-1-propen-3-one
m/z 209

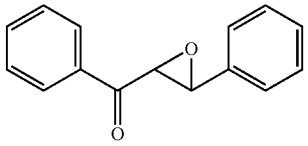

1,3-Diphenyl-1,2-epoxy-propan-3-one
m/z 225

It can be learned from FIG. 10*a* that, when the reactant exists by itself, a signal with a mass/charge ratio (i/z) of 209 can be obtained. Next, after adding the catalyst NaOH, no change occurs in the reactant, as shown in FIG. 10*b*, and still there is merely a signal with a mass/charge ratio (m/z) of 209. Then, once $H_2O_2$ is added, a product is generated, as shown in FIGS. 10*c* to 10*g*, and signals of the product 1,3-diphenyl-1,2-epoxy-propan-3-one with a mass/charge ratio (m/z) of 225 can be obtained, and signal of 2,3-dihydroxy-1,3-diphenyl-propan-1-one with a mass/charge ratio (m/z) of 242 can be obtained, which lacks an OH group compared with the product.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. A mass analyzing apparatus, comprising:

a first metal electrode plate, having a plurality of first through-holes;

a second metal electrode plate, having a plurality of second through-holes, wherein the second metal electrode plate is grounded, and there is a gap between the second metal electrode plate and the first metal electrode plate so as to form a face discharge room, the first through-holes communicate with the face discharge room, and the second through-holes communicate with the face discharge room;

an RF power supply, electrically connected to the first metal electrode plate, to cause electric face discharge in the face discharge room between the first metal electrode plate and the second metal electrode plate;

a reactant gas, passing through the first metal electrode plate and the second metal electrode plate to become a dissociation plasma by a face discharging process in the face discharge room; and a mass spectrometer for a mass analysis after the plasma reacts with a gas analyte from a sample and then enters the mass spectrometer.

2. The mass analyzing apparatus as claimed in claim 1, wherein the first metal electrode plate and the second metal electrode plate are made of conductive metals, and the first metal electrode plate and the second metal electrode plate are parallel.

3. The mass analyzing apparatus as claimed in claim 1, further comprising a first cylinder, a second cylinder, and an insulation layer, wherein the first cylinder is located within the second cylinder, the first metal electrode plate is connected to the first cylinder, the second metal electrode plate is connected to the second cylinder, and the insulation layer is located between an outer wall of the first cylinder and an inner wall of the second cylinder.

4. The mass analyzing apparatus as claimed in claim 3, further comprising a ring-shaped pad, located between the first metal electrode plate and the second metal electrode plate, and the second metal electrode plate, the first metal electrode plate and the ring-shaped pad define the face discharge room.

5. The mass analyzing apparatus as claimed in claim 1, wherein the mass spectrometry has a sample receiver, and the plasma reacts with the gas analyte and then enters the mass spectrometry through the sample receiver for a mass analysis.

6. The mass analyzing apparatus as claimed in claim 5, further comprising a cover, for covering the second metal electrode plate and the sample receiver, and the sample is disposed within the cover.

7. The mass analyzing apparatus as claimed in claim 6, further comprising a heating plate, located below the cover, for heating the sample.

8. The mass analyzing apparatus as claimed in claim 1, further comprising a heating plate, for heating the sample.

9. The mass analyzing apparatus as claimed in claim 1, wherein the reactant gas is selected from a group consisting of helium, argon, nitrogen, and air.

10. The mass analyzing apparatus as claimed in claim 1, further comprising a laser generator, for generating a laser for irradiating the sample, so as to generate a gas analyte.

* * * * *